US012415592B2

(12) United States Patent
Ito

(10) Patent No.: US 12,415,592 B2
(45) Date of Patent: Sep. 16, 2025

(54) MARINE VESSEL EQUIPPED WITH STEERING MECHANISM FOR MARINE VESSEL, AND STEERING HANDLE FOR MARINE VESSEL

(71) Applicant: YAMAHA HATSUDOKI KABUSHIKI KAISHA, Iwata (JP)

(72) Inventor: Takuma Ito, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 297 days.

(21) Appl. No.: 17/976,990

(22) Filed: Oct. 31, 2022

(65) Prior Publication Data

US 2023/0150641 A1 May 18, 2023

(30) Foreign Application Priority Data

Nov. 17, 2021 (JP) ..... 2021-187173

(51) Int. Cl.

| | |
|---|---|
| ***B60L 3/00*** | (2019.01) |
| ***B63H 20/12*** | (2006.01) |
| ***B63H 21/21*** | (2006.01) |
| ***B63H 25/02*** | (2006.01) |
| *B63H 20/00* | (2006.01) |

(52) U.S. Cl.

CPC ..... *B63H 25/02* (2013.01); *B63H 20/12* (2013.01); *B63H 21/213* (2013.01); *B63H 2020/003* (2013.01); *B63H 2021/216* (2013.01); *B63H 2025/022* (2013.01); *B63H 2025/026* (2013.01)

(58) Field of Classification Search

CPC ..... B63H 25/02; B63H 20/12; B63H 21/213; B63H 2020/003; B63H 2021/216; B63H 2025/022; B63H 2025/026

See application file for complete search history.

(56) References Cited

U.S. PATENT DOCUMENTS

| | | | | |
|---|---|---|---|---|
| 7,278,367 | B1 | 10/2007 | Gonring et al. | |
| 2012/0004818 | A1* | 1/2012 | Wakita | F16H 59/0204 74/473.18 |
| 2016/0304181 | A1 | 10/2016 | Steven | |
| 2018/0111671 | A1 | 4/2018 | Shibayama et al. | |
| 2018/0251203 | A1 | 9/2018 | Shibayama et al. | |
| 2018/0273152 | A1 | 9/2018 | Koyano et al. | |
| 2019/0112021 | A1* | 4/2019 | Watanabe | B63H 5/08 |
| 2021/0053665 | A1 | 2/2021 | Fujino | |

OTHER PUBLICATIONS

Yamaha Motor Co., Ltd., "Helm Master Ex",https://www.yamaha-motor.co.jp/marine/lineup/outboard/helmmasterex, Searched from the Internet, Nov. 8, 2021, 4 pages.

Extended European Search Report in EP22202165.1, mailed Apr. 17, 2023, 7 pages.

* cited by examiner

*Primary Examiner* — Adam M Alharbi

(74) *Attorney, Agent, or Firm* — Keating & Bennett, LLP

(57) ABSTRACT

A marine vessel includes a steering mechanism to improve the operability of an operator that changes a speed of the marine vessel. The steering mechanism includes a steering wheel, a speed increasing paddle to accelerate the marine vessel, and a speed decreasing paddle to decelerate the marine vessel.

18 Claims, 8 Drawing Sheets

MARINE VESSEL EQUIPPED WITH STEERING MECHANISM FOR MARINE VESSEL, AND STEERING HANDLE FOR MARINE VESSEL

CROSS REFERENCE TO RELATED APPLICATIONS

This application claims the benefit of priority to Japanese Patent Application No. 2021-187173, filed on Nov. 17, 2021. The entire contents of this application are hereby incorporated herein by reference.

BACKGROUND OF THE INVENTION

1. Field of the Invention

The present invention relates to a marine vessel equipped with a steering mechanism for a marine vessel, and a steering handle for a marine vessel.

2. Description of the Related Art

A speed of a marine vessel is adjusted by operating a lever of a remote control switch provided at a maneuvering seat. In recent years, with the aim of reducing the burden on a marine vessel operator or the like, a marine vessel maneuvering system of the marine vessel has been equipped with a constant speed navigation mode that keeps the speed of the marine vessel constant without the marine vessel operator continuing to operate the lever of the remote control switch. For example, as shown in FIG. 8, a speed control switch 82 functioning as an operator is provided on the side face of a lever 81 of a remote control switch 80, and after the marine vessel operator operates the lever 81 of the remote control switch 80 to increase the speed of the marine vessel to a predetermined speed, when the marine vessel operator operates the speed control switch 82, the marine vessel shifts to the constant speed navigation mode in which the marine vessel continues to navigate at the predetermined speed. Such a speed control switch 82 is provided with up and down buttons (indicated by "+" and "−" in FIG. 8), and by operating the up and down buttons, it is possible for the marine vessel operator to change the speed of the marine vessel navigating in the constant speed navigation mode (For example, see "Helm Master EX", [online], Yamaha Motor Co., Ltd., [searched on Nov. 8, 2021], Internet <URL:https://www.yamaha-motor.co.jp/marine/lineup/outboard/helmmasterex/>).

However, the predetermined speed when the marine vessel is navigating in the constant speed navigation mode is often a relatively high speed, and in order to maintain the course of the marine vessel, the marine vessel operator needs to keep holding a steering wheel.

Therefore, in the case of changing the speed of the marine vessel navigating in the constant speed navigation mode with the up and down buttons of the speed control switch 82, since the marine vessel operator needs to hold the steering wheel with one hand and operate the speed control switch 82 of the remote control switch 80 located away from the steering wheel with the other hand, it is not easy for the marine vessel operator to operate the speed control switch 82 accurately. In addition, since the up and down buttons are provided along with the speed control switch 82, they cannot be made large, and the operability is not good. That is, there is room for improvement in the operability of the operator for changing the speed of the marine vessel.

SUMMARY OF THE INVENTION

Preferred embodiments of the present invention provide marine vessels equipped with steering mechanisms, and steering handles that are each able to improve the operability of an operator to change a speed of a marine vessel.

According to a preferred embodiment of the present invention, a marine vessel includes a steering mechanism including a steering wheel, a speed increasing paddle to accelerate the marine vessel, and a speed decreasing paddle to decelerate the marine vessel.

According to another preferred embodiment of the present invention, a marine vessel includes a steering mechanism including a steering wheel, a speed increasing switch to accelerate the marine vessel, and a speed decreasing switch to decelerate the marine vessel. The steering wheel includes a central portion supported rotatably around a rotation fulcrum with respect to a hull of the marine vessel, a wheel portion having an annular shape, and at least two spoke portions that connect the central portion and the wheel portion. The at least two spoke portions are positioned above a virtual plane extending through the rotation fulcrum and parallel to a left/right direction, and are positioned within an angle range from about 0° to about 60° with respect to the virtual plane in a circumferential direction about the rotation fulcrum. The speed increasing switch and the speed decreasing switch are located on the at least two spoke portions, respectively.

According to another preferred embodiment of the present invention, a steering handle for a marine vessel includes a steering wheel, a speed increasing paddle to accelerate the marine vessel, and a speed decreasing paddle to decelerate the marine vessel.

According to preferred embodiments of the present invention, although the steering mechanism for the marine vessel includes the steering wheel, the speed increasing paddle to accelerate the marine vessel, and the speed decreasing paddle to decelerate the marine vessel, since the speed increasing paddle and the speed decreasing paddle are able to be configured (made) larger than a speed control switch, it is possible for a marine vessel operator to easily operate the speed increasing paddle and the speed decreasing paddle. Further, since the speed increasing switch and the speed decreasing switch are located on each of the at least two spoke portions of the steering wheel of the steering mechanism for the marine vessel, it is possible for the marine vessel operator to operate the speed increasing switch and the speed decreasing switch without taking his/her hands off the steering wheel. As a result, it is possible to improve the operability of the operator to change the speed of the marine vessel.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
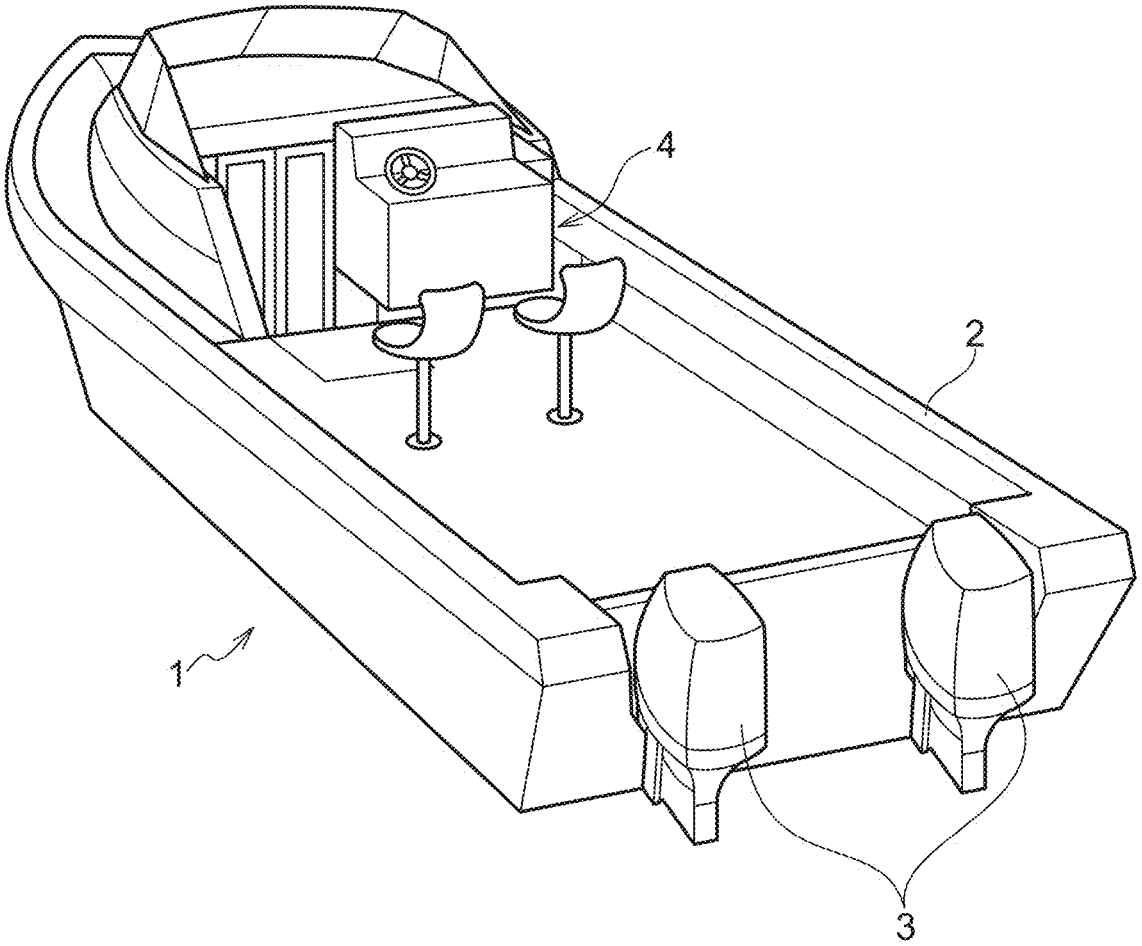
FIG. 1 is a perspective view of a marine vessel equipped with a steering mechanism according to a preferred embodiment of the present invention.

FIG. 1 is a perspective view of a marine vessel equipped with a steering mechanism according to a preferred embodiment of the present invention. A marine vessel 1 includes a hull 2, and a plurality of, for example, two outboard motors 3 that function as marine vessel propulsion devices and are mounted on the hull 2. It should be noted that the number of the outboard motors 3 provided on the marine vessel 1 is not limited to two, and may be one or three or more. The two outboard motors 3 are mounted side by side on the stern of the hull 2. Each outboard motor 3 includes an engine (not shown) which may be an internal combustion engine functioning as a power source, and obtains a thrust from a propeller (not shown) which is rotated by a driving force of the corresponding engine. It should be noted that each outboard motor 3 may include an electric motor functioning as the power source, or may include both an engine and an electric motor functioning as the power source.

Figure 2:
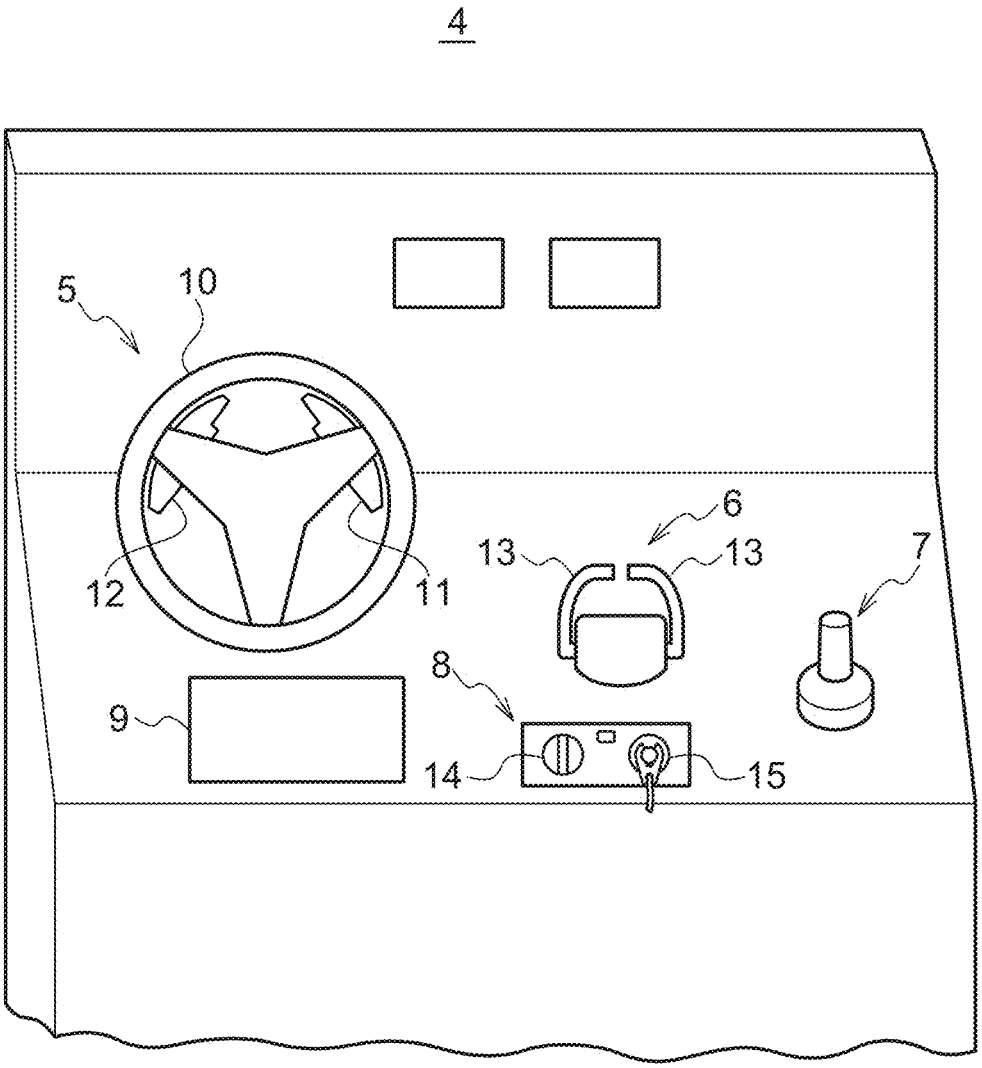
FIG. 2 is a perspective view of a principal portion of a maneuvering seat.

In addition, in the marine vessel 1, a maneuvering seat 4 is provided on the bow side, which is the front portion of the hull 2. FIG. 2 is a perspective view of a principal portion of the maneuvering seat 4. A steering mechanism 5 for a marine vessel (hereinafter, also simply referred to as "a marine vessel steering mechanism 5") that functions as a steering handle for a marine vessel), a remote control switch 6, a joystick 7, a main operation unit 8, and an MFD (Multi Function Display) 9 are located near the maneuvering seat 4.

The marine vessel steering mechanism 5 enables a marine vessel operator to determine the course of the marine vessel 1. The marine vessel steering mechanism 5 includes a steering wheel 10 which is rotatably operated, and speed adjusting paddles 11 and 12. The marine vessel operator is able to turn the marine vessel 1 left or right by rotatably operating the steering wheel 10 left or right. Further, the marine vessel operator is able to increase a rotation speed of the engine of the outboard motor 3 by operating the speed adjusting paddle 11 (a speed increasing paddle) so as to increase a vessel speed of the marine vessel 1. On the other hand, the marine vessel operator is able to decrease the rotation speed of the engine of the outboard motor 3 by operating the speed adjusting paddle 12 (a speed decreasing paddle) so as to decrease the vessel speed of the marine vessel 1.

The remote control switch 6 includes levers 13 corresponding to the outboard motors 3, respectively. By operating each lever 13, the marine vessel operator is able to switch a direction of the thrust generated by the corresponding outboard motor 3 between a forward moving direction and a backward moving direction, and adjust the output of the corresponding outboard motor 3 so as to adjust the vessel speed of the marine vessel 1.

The joystick 7 is operable to be tilted forward, backward, leftward and rightward, and also operable to rotate about an axis. By operating the joystick 7, the marine vessel operator is able to navigate the marine vessel 1 with a course corresponding to a tilting direction of the joystick 7 and a thrust corresponding to a tilting amount of the joystick 7. In a normal mode, the outboard motor 3 works mainly according to an operation of the marine vessel steering mechanism 5 and an operation of the remote control switch 6. On the other hand, in a joystick mode, the outboard motor 3 works mainly according to an operation of the joystick 7. It is possible to switch between the normal mode and the joystick mode by a change-over switch (not shown).

The main operation unit 8 includes a main switch 14 and an emergency switch 15. The main switch 14 (one main switch 14) is provided in common for the outboard motors 3 (respective outboard motors 13). The main switch 14 is an operator to collectively start and collectively stop the engines of the outboard motors 3 (the respective outboard motors 13).

The MFD 9 is, for example, a color LCD display. The MED 9 functions as a display that displays various kinds of information, and also functions as a touch panel that accepts inputs from the marine vessel operator. For example, the MFD 9 displays the rotation speed of the engine of each outboard motor 3 and the vessel speed of the marine vessel 1, and as will be described below, accepts settings to change functions assigned to the speed adjusting paddles 11 and 12.

Figure 3:
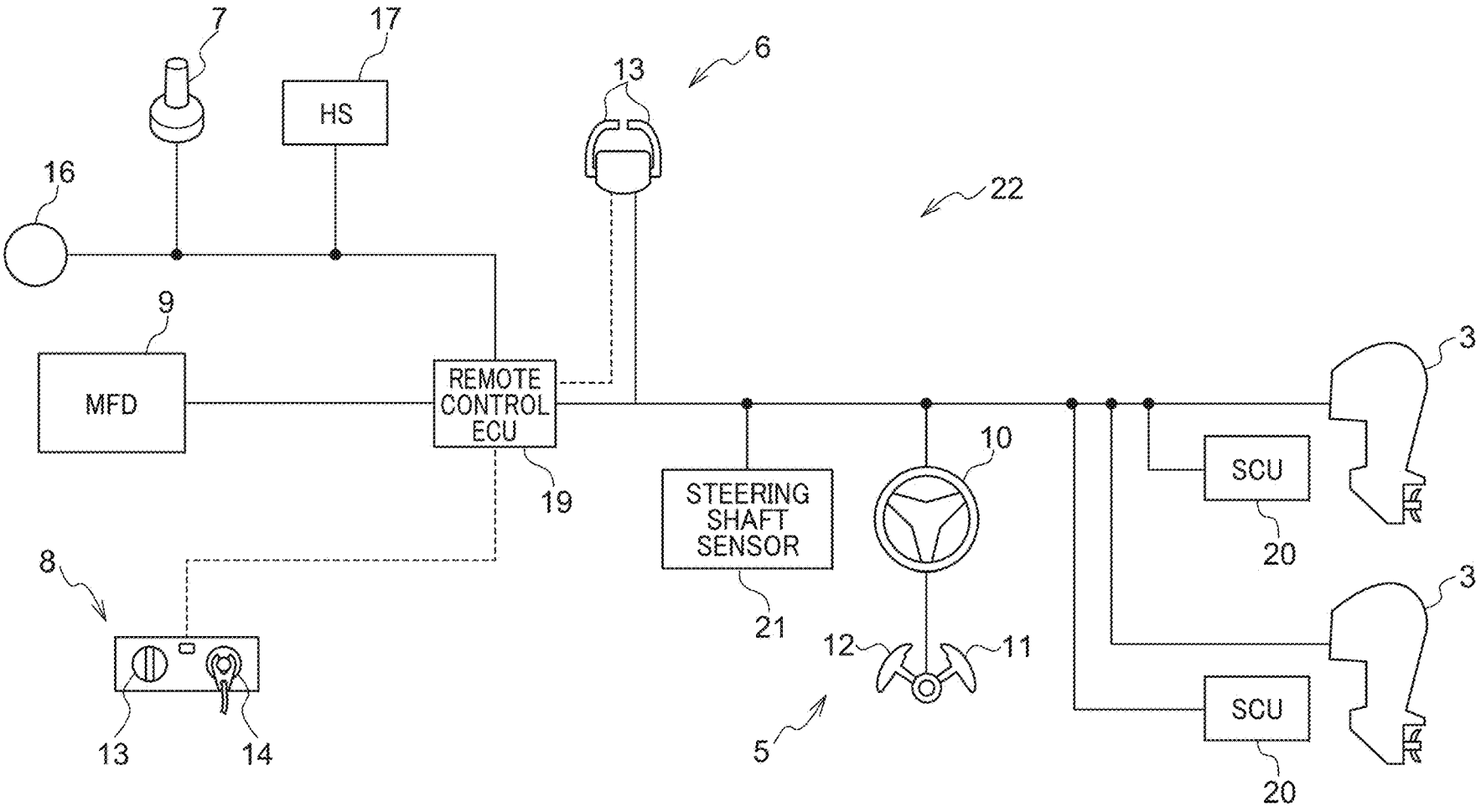
FIG. 3 is a block diagram for schematically explaining a configuration of a marine vessel maneuvering system of the marine vessel of FIG. 1.

FIG. 3 is a block diagram for schematically explaining a configuration of a marine vessel maneuvering system of the marine vessel 1. As shown in FIG. 3, in addition to the outboard motors 3, the marine vessel steering mechanism 5, the remote control switch 6, the joystick 7, the main operation unit 8, and the MFD 9 that are described above, the marine vessel maneuvering system of the marine vessel 1 includes a GPS (Global Positioning System) 16, an HS (Heading Sensor) 17, a remote control ECU (Engine Control Unit) 19 functioning as a controller, SCUs (Steering Control Units) 20, and a steering shaft sensor 21.

The GPS 16 obtains the current position of the marine vessel 1 and transmits the current position of the marine vessel 1 to the remote control ECU 19 as position information. The HS 17 incorporates direction sensors (azimuth sensors) such as a yaw sensor, a roll sensor, and a pitch sensor, an acceleration sensor that measures an acceleration of the marine vessel 1 in a front-rear direction (a longitudinal direction), an acceleration sensor that measures an acceleration of the marine vessel 1 in a left/right direction, and an acceleration sensor that measures an acceleration of the marine vessel 1 in a vertical direction. The HS 17 transmits a direction of the marine vessel 1 and the respective accelerations (movement) of the marine vessel 1 to the remote control ECU 19.

The remote control ECU 19 is a main controller of the marine vessel maneuvering system, and controls operations of respective components of the marine vessel maneuvering system according to digital signals that will be described below, and various kinds of programs. In addition, the remote control ECU 19 controls the engine of each outboard motor 3 according to the operation of each lever 13 of the remote control switch 6. The SCU 20 is provided corresponding to each outboard motor 3, and controls a steering unit (a steering mechanism) that horizontally turns the corresponding outboard motor 3 with respect to the hull 2 of the marine vessel 1 so as to change an acting direction of the thrust of each outboard motor 3. The steering shaft sensor 21 detects a rotation angle (an operation angle) of the steering wheel 10 of the marine vessel steering mechanism 5.

In the marine vessel maneuvering system, the respective components are connected to each other by a CAN (Control Area Network) 22 that is a network in which a plurality of nodes are individually connected to a bus. In the CAN 22, operation inputs to the respective components are transmitted as the digital signals to the remote control ECU 19 via the bus.

In addition, in the marine vessel maneuvering system, the remote control switch 6 is connected to the remote control ECU 19 not only by the CAN 22 but also by individual wiring (see a broken line in FIG. 3), and the main operation unit 8 is connected to the remote control ECU 19 not by the CAN 22 but by individual wiring (see a broken line in FIG. 3). The operation input to each lever 13 of the remote control switch 6 is transmitted also as an analog signal to the remote control ECU 19, and the operation input to the main switch 14 of the main operation unit 8 and the operation input to the emergency switch 15 of the main operation unit 8 are also transmitted as analog signals to the remote control ECU 19.

Furthermore, in the marine vessel steering mechanism 5, the speed adjusting paddles 11 and 12 are connected to the CAN 22 via a steering substrate (not shown) of the marine vessel steering mechanism 5. The operation inputs to the speed adjusting paddles 11 and 12 are transmitted as the digital signals to the remote control ECU 19 via the steering substrate.

It should be noted that in the marine vessel maneuvering system, the respective components may be connected to each other not by the CAN but by a LAN (Local Area Network) such as Ethernet (registered trademark) that performs connecting via a network device, or the respective components may be directly connected to each other. Also in this case, the operation inputs to the respective components are transmitted as the digital signals to the remote control ECU 19.

Figure 4:
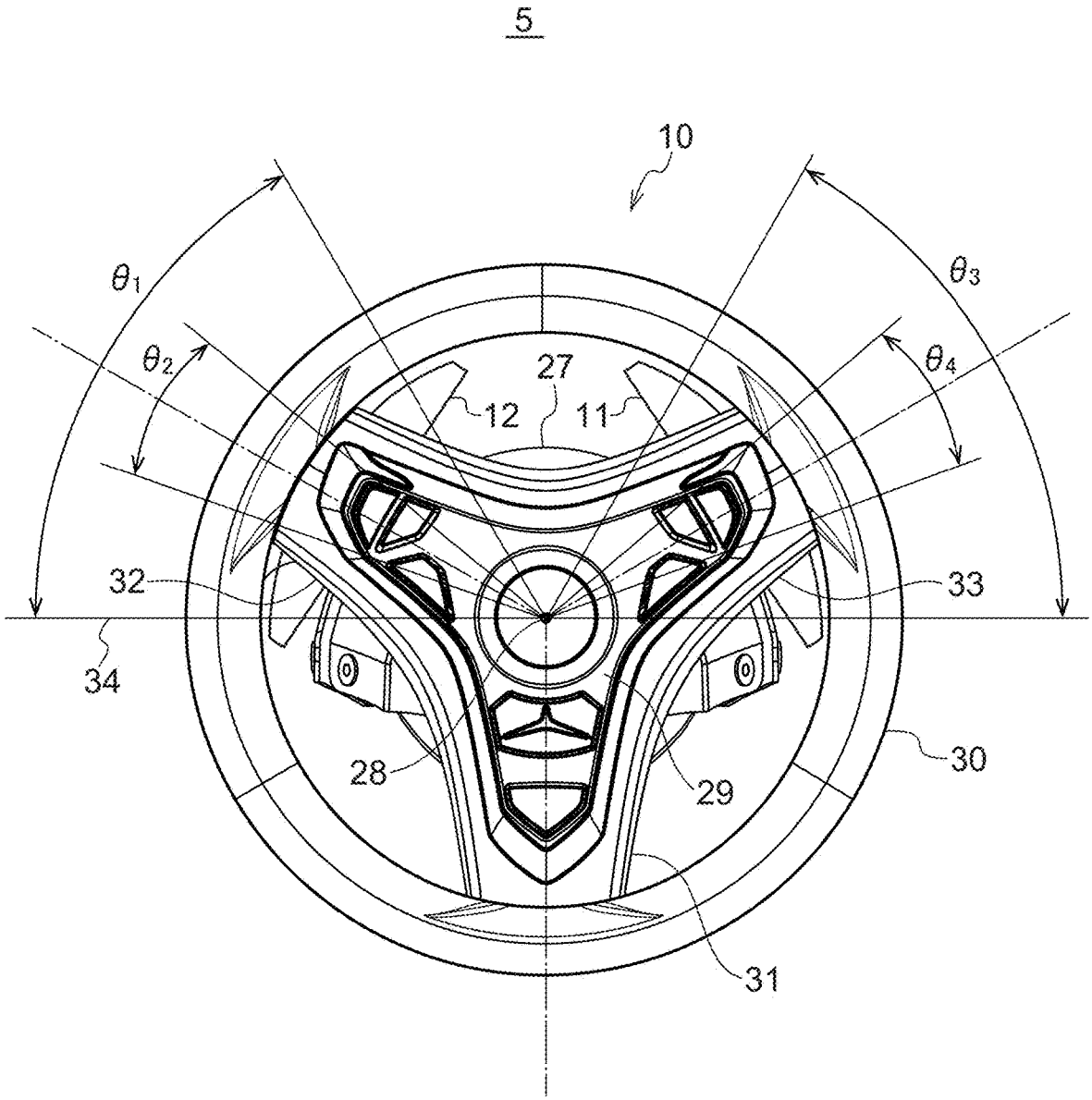
FIG. 4 is a view for explaining a configuration of the steering mechanism for the marine vessel.
Figure 5:
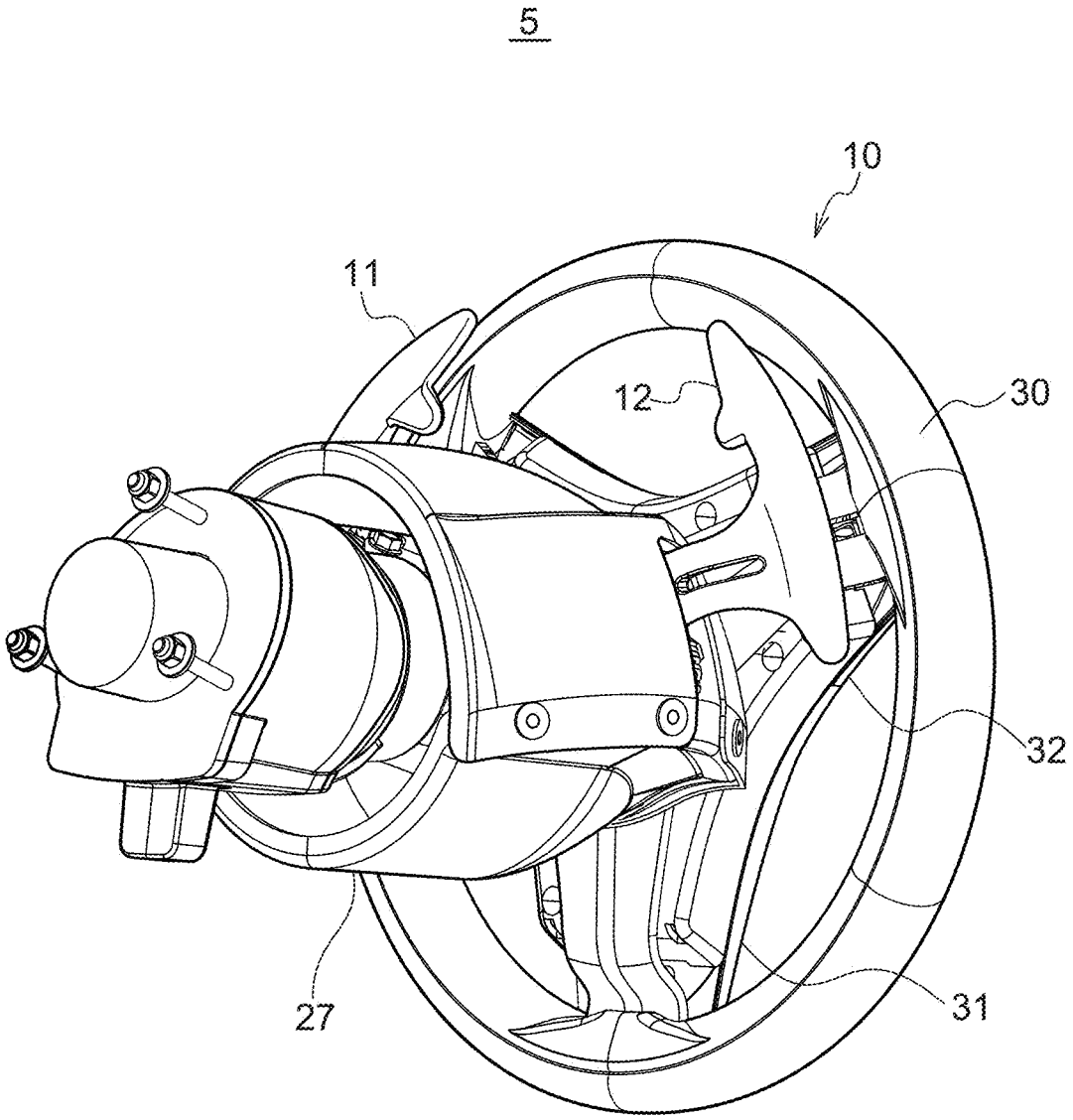
FIG. 5 is a view for explaining the configuration of the steering mechanism for the marine vessel.

FIG. 4 and FIG. 5 are views for explaining a configuration of the marine vessel steering mechanism 5. FIG. 4 shows a case in which the marine vessel steering mechanism 5 is viewed opposite from the side of the marine vessel operator, and FIG. 5 shows a case that the marine vessel steering mechanism 5 is obliquely viewed from the opposite side of the marine vessel operator. It should be noted that a vertical direction and a left/right direction of FIG. 4 correspond to the vertical direction and the left/right direction of the marine vessel 1, the depth side of FIG. 4 is the bow side of the marine vessel 1, and the front side of FIG. 4 is the stern side of the marine vessel 1.

As shown in FIG. 4 and FIG. 5, the marine vessel steering mechanism 5 includes the steering wheel 10, the speed adjusting paddles 11 and 12, and a column portion 27 that pivotally and rotatably supports the steering wheel 10. The steering wheel 10 includes a central portion 29 that is supported rotatably around a rotation fulcrum (a steering shaft) 28 with respect to the column portion 27, a wheel portion 30 that has an annular shape, and at least two spoke portions, for example, three spoke portions (spoke portions 31, 32, and 33) that connect the central portion 29 and the wheel portion 30.

The speed adjusting paddle 11 is a substantially T-shaped lever, and protrudes rightward from the column portion 27 when viewed opposite from the side of the marine vessel operator. Furthermore, the speed adjusting paddle 12 is also a substantially T-shaped lever, and protrudes leftward from the column portion 27 when viewed opposite from the side of the marine vessel operator. On the other hand, the steering wheel 10 is provided on the stern side of the column portion 27. That is, the speed adjusting paddle 11, the speed adjusting paddle 12, and the steering wheel 10 are separate from the column portion 27. It is preferable that both the speed adjusting paddle 11 and the speed adjusting paddle 12 are located within a range that fingers of the marine vessel operator who is gripping the wheel portion 30 are able to reach.

The column portion 27 supports the speed adjusting paddles 11 and 12 so that they are able to be tilted substantially forward and backward, respectively. Each of the speed adjusting paddles 11 and 12 accepts the operation when the marine vessel operator pulls the respective speed adjusting paddles 11 and 12 toward the front side once. The operations of the speed adjusting paddles 11 and 12, that is, the tilting or moving of the speed adjusting paddles 11 and 12 toward the front side of the marine vessel operator are/is converted into analog signals by, for example, a potentiometer, and transmitted to the steering substrate of the marine vessel steering mechanism 5. It should be noted that the speed adjusting paddle 11 (the speed increasing paddle) may protrude leftward from the column portion 27 when viewed opposite from the side of the marine vessel operator, and the speed adjusting paddle 12 (the speed decreasing paddle) may protrude rightward from the column portion 27 when viewed opposite from the side of the marine vessel operator.

When the steering wheel 10 is at a position that makes the marine vessel 1 move straight, the spoke portion 31 is positioned below a virtual plane 34 extending through the rotation fulcrum 28 and parallel to the left/right direction, and extends downward from the rotation fulcrum 28.

Further, when the steering wheel 10 is at the position that makes the marine vessel 1 move straight, the spoke portion 32 (the other spoke portion) is positioned above the virtual plane 34, and extends from the rotation fulcrum 28 so as to be positioned within an angle range from about 0° to about 60°, for example, clockwise with respect to the virtual plane 34 in a circumferential direction about the rotation fulcrum 28 (within an angle range indicated by θ1 in FIG. 4), preferably, so as to be positioned within an angle range from about 20° to about 40°, for example, clockwise with respect to the virtual plane 34 in the circumferential direction about the rotation fulcrum 28 (within an angle range indicated by θ2 in FIG. 4).

Furthermore, when the steering wheel 10 is at the position that makes the marine vessel 1 move straight, the spoke portion 33 (one spoke portion) is positioned above the virtual plane 34, and extends from the rotation fulcrum 28 so as to be positioned within an angle range from about 0° to about 60° counterclockwise with respect to the virtual plane 34 in the circumferential direction about the rotation fulcrum 28 (within an angle range indicated by θ3 in FIG. 4), preferably, so as to be positioned within an angle range from about 20° to about 40° counterclockwise with respect to the virtual plane 34 in the circumferential direction about the rotation fulcrum 28 (within an angle range indicated by θ4 in FIG. 4).

In the marine vessel steering mechanism 5, when the steering wheel 10 is viewed from the marine vessel operator, the spoke portion 32 and the speed adjusting paddle 12 are located so as to overlap each other, and the spoke portion 33 and the speed adjusting paddle 11 are located so as to overlap each other.

When the marine vessel 1 is navigating, sometimes the marine vessel operator grips the wheel portion 30 while standing, at that time, since the marine vessel operator holds the wheel portion 30 from above, the marine vessel operator grips the upper half of the wheel portion 30, particularly grips the vicinity where the wheel portion 30 intersects the spoke portions 32 and 33. Therefore, since the marine vessel operator is able to operate the speed adjusting paddle 11 and the speed adjusting paddle 12 with his or her fingers without regripping the wheel portion 30, the operability of the speed adjusting paddles 11 and 12 is improved.

In addition, the speed adjusting paddles 11 and 12 are attached to the column portion 27 so as to rotate in the same manner as the steering wheel 10 rotates. Therefore, even in the case that the steering wheel 10 rotates, when the steering wheel 10 is viewed from the marine vessel operator, the spoke portion 32 and the speed adjusting paddle 12 remain overlapped, and the spoke portion 33 and the speed adjusting paddle 11 remain overlapped. It should be noted that the speed adjusting paddles 11 and 12 may be fixed to the column portion 27 with respect to a rotational operation direction of the steering wheel 10 so that even in the case that the steering wheel 10 rotates, the speed adjusting paddles 11 and 12 do not rotate.

As described above, in the CAN 22, the operation input to the speed adjusting paddle 11 and the operation input to the speed adjusting paddle 12 are transmitted as the digital signals to the remote control ECU 19 via the steering substrate of the marine vessel steering mechanism 5. When the remote control ECU 19 receives a digital signal indicating that the speed adjusting paddle 11 has been operated, the remote control ECU 19 transmits a control signal to an ECU (not shown) of each outboard motor 3 to increase the rotation speed of the engine of each outboard motor 3 by a predetermined rotation speed, for example, about 50 rpm. In addition, when the remote control ECU 19 receives a digital signal indicating that the speed adjusting paddle 12 has been operated, the remote control ECU 19 transmits a control signal to the ECU of each outboard motor 3 to decrease the rotation speed of the engine of each outboard motor 3 by a predetermined rotation speed, for example, about 50 rpm. In a preferred embodiment of the present invention, the number of times of operations of the speed adjusting paddles 11 and 12 that are able to change the vessel speed of the marine vessel 1 is limited, for example, the number of times of the operations of the speed adjusting paddles 11 and 12 is limited to 10 times. In this case, the marine vessel operator is able to increase or decrease the rotation speed of the engine by up to about 500 rpm by operating the speed adjusting paddles 11 and 12.

Furthermore, when the vessel speed of the marine vessel 1 is high, since it is difficult to feel a change in the vessel speed even in the case that the vessel speed changes slightly, it is preferable that the width of the vessel speed that changes by one operation of the speed adjusting paddle 11 or the speed adjusting paddle 12 is large. On the other hand, when the vessel speed of the marine vessel 1 is low, since even a slight change in the vessel speed can be felt, it is preferable that the width of the vessel speed that changes by one operation of the speed adjusting paddle 11 or the speed adjusting paddle 12 is small. In response to this, in a preferred embodiment of the present invention, the rotation speed of the engine, which is changed by one operation of the speed adjusting paddle 11 or the speed adjusting paddle 12, may be changed according to the vessel speed of the marine vessel 1. For example, when the vessel speed of the marine vessel 1 is high, the rotation speed of the engine, which is changed by one operation of the speed adjusting paddle 11 or the speed adjusting paddle 12, may be set to be larger than about 50 rpm, and when the vessel speed of the marine vessel 1 is low, the rotation speed of the engine, which is changed by one operation of the speed adjusting paddle 11 or the speed adjusting paddle 12, may be set to be smaller than about 50 rpm. As a result, the marine vessel operator is able to naturally accelerate and decelerate the marine vessel 1 by operating the speed adjusting paddles 11 and 12.

In a preferred embodiment of the present invention, although the remote control ECU 19 changes the rotation speed of the engine by the predetermined rotation speed according to the operation of the speed adjusting paddle 11 or the speed adjusting paddle 12, the remote control ECU 19 may monitor the vessel speed of the marine vessel 1 based on the position information from the GPS 16, and may control each outboard motor 3 so as to change the vessel speed of the marine vessel 1 by a predetermined amount according to the operation of the speed adjusting paddle 11 or the speed adjusting paddle 12. Specifically, when the remote control ECU 19 receives the digital signal indicating that the speed adjusting paddle 11 has been operated, the remote control ECU 19 transmits the control signal to the ECU of each outboard motor 3, and controls each outboard motor 3 so as to increase the vessel speed of the marine vessel 1 by the predetermined amount. Furthermore, when the remote control ECU 19 receives the digital signal indicating that the speed adjusting paddle 12 has been operated, the remote control ECU 19 transmits the control signal to the ECU of each outboard motor 3, and controls each outboard motor 3 so as to decrease the vessel speed of the marine vessel 1 by the predetermined amount. Also in this case, a change amount of the vessel speed due to one operation of the speed adjusting paddle 11 or the speed adjusting paddle 12 may be changed according to the vessel speed of the marine vessel 1. For example, when the vessel speed of the marine vessel 1 is high, the predetermined amount, which is the change amount of the vessel speed due to one operation of the speed adjusting paddle 11 or the speed adjusting paddle 12, is set to be large, and when the vessel speed of the marine vessel 1 is low, the predetermined amount, which is the change amount of the vessel speed due to one operation of the speed adjusting paddle 11 or the speed adjusting paddle 12, is set to be small.

Since the speed adjusting paddles 11 and 12 transmit the digital signals according to the operation inputs, by assigning arbitrary functions to these digital signals it is possible to change functions executed by the operations of the speed adjusting paddles 11 and 12. For example, the function of changing the rotation speed of the engine by the predetermined rotation speed according to the operation of the speed adjusting paddle 11 may be changed to the function of changing the vessel speed of the marine vessel 1 by the predetermined amount according to the operation of the speed adjusting paddle 11. This change is realized by the marine vessel operator using the MED 9 to change an assignment of functions to the digital signals with respect to the operation inputs to the speed adjusting paddles 11 and 12.

Also, like the speed control switch 82, the speed adjusting paddles 11 and 12 function as switches to shift the marine vessel 1 to a constant speed navigation mode in which the marine vessel 1 continues to navigate at a constant speed. For example, in the case that the navigation mode of the marine vessel 1 is not the constant speed navigation mode, when the marine vessel operator operates the speed adjusting paddle 11 or the speed adjusting paddle 12 once, in response to this operation, the remote control ECU 19 shifts the marine vessel 1 to the constant speed navigation mode in which the vessel speed at that time is maintained. After the marine vessel 1 shifts to the constant speed navigation mode, when the operation of only the speed adjusting paddle 11 or the speed adjusting paddle 12 is newly accepted, in response to this newly accepted operation, the remote control ECU 19 accelerates or decelerates the marine vessel 1 as described above. Furthermore, in a preferred embodiment of the present invention, when the marine vessel operator simultaneously operates the speed adjusting paddle 11 and the speed adjusting paddle 12, the remote control ECU 19 releases the constant speed navigation mode of the marine vessel 1.

It should be noted that shifting to the constant speed navigation mode may be performed according to the operation of a speed control switch located on the lever 13 of the remote control switch 6, and releasing of the constant speed navigation mode may be performed according to the operation of the lever 13 of the remote control switch 6 (movement of the lever 13 from its current position to another position).

According to a preferred embodiment of the present invention, although the speed adjusting paddle 11 to increase the vessel speed and the speed adjusting paddle 12 to decrease the vessel speed are located on the marine vessel steering mechanism 5, the speed adjusting paddles 11 and 12 may be made larger than the speed control switch of the remote control switch 6. In particular, in the marine vessel steering mechanism 5, in the case that the speed adjusting paddles 11 and 12 are located within the range that the fingers of the marine vessel operator who is gripping the wheel portion 30 are able to reach, the marine vessel operator is able to operate the speed adjusting paddle 11 and the speed adjusting paddle 12 with his or her fingers without regripping the wheel portion 30. As a result, the marine vessel operator is able to easily operate the speed adjusting paddles 11 and 12, and it is possible to improve the operability of the speed adjusting paddles 11 and 12. Furthermore, since the marine vessel operator is able to operate the speed adjusting paddles 11 and 12 without taking his/her hands off the wheel portion 30, for example, in the case that the sea is rough with waves, since the marine vessel operator does not need to take his/her hands off the wheel portion 30 when adjusting the vessel speed of the marine vessel 1, the marine vessel operator is able to maintain the course of the marine vessel 1 even in rough weather.

Although preferred embodiments of the present invention have been described above, the present invention is not limited to the above-described preferred embodiments, and various modifications and changes can be made within the scope of the gist thereof.

For example, although when the speed adjusting paddle 11 is operated, the vessel speed of the marine vessel 1 increases, and when the speed adjusting paddle 12 is operated, the vessel speed of the marine vessel 1 decreases, the marine vessel maneuvering system may be configured so that when the speed adjusting paddle 11 is operated, the vessel speed of the marine vessel 1 decreases, and when the speed adjusting paddle 12 is operated, the vessel speed of the marine vessel 1 increases.

In addition, functions other than the function of adjusting the vessel speed of the marine vessel 1 may be assigned to the speed adjusting paddles 11 and 12. For example, in the case that the marine vessel 1 navigates at an extremely low speed, a function of moving the marine vessel 1 forward at an extremely low speed during operation may be assigned to the speed adjusting paddle 11, and a function of moving the marine vessel 1 backward at an extremely low speed during operation may be assigned to the speed adjusting paddle 12. In this case, when the marine vessel 1 is not navigating at the extremely low speed, as described above, the function of adjusting the vessel speed of the marine vessel 1 is assigned to the speed adjusting paddles 11 and 12. Settings of these functions are realized by the marine vessel operator using the MFD 9 to perform assignment of respective functions to the digital signals with respect to the operation inputs to the speed adjusting paddles 11 and 12.

Figure 6:
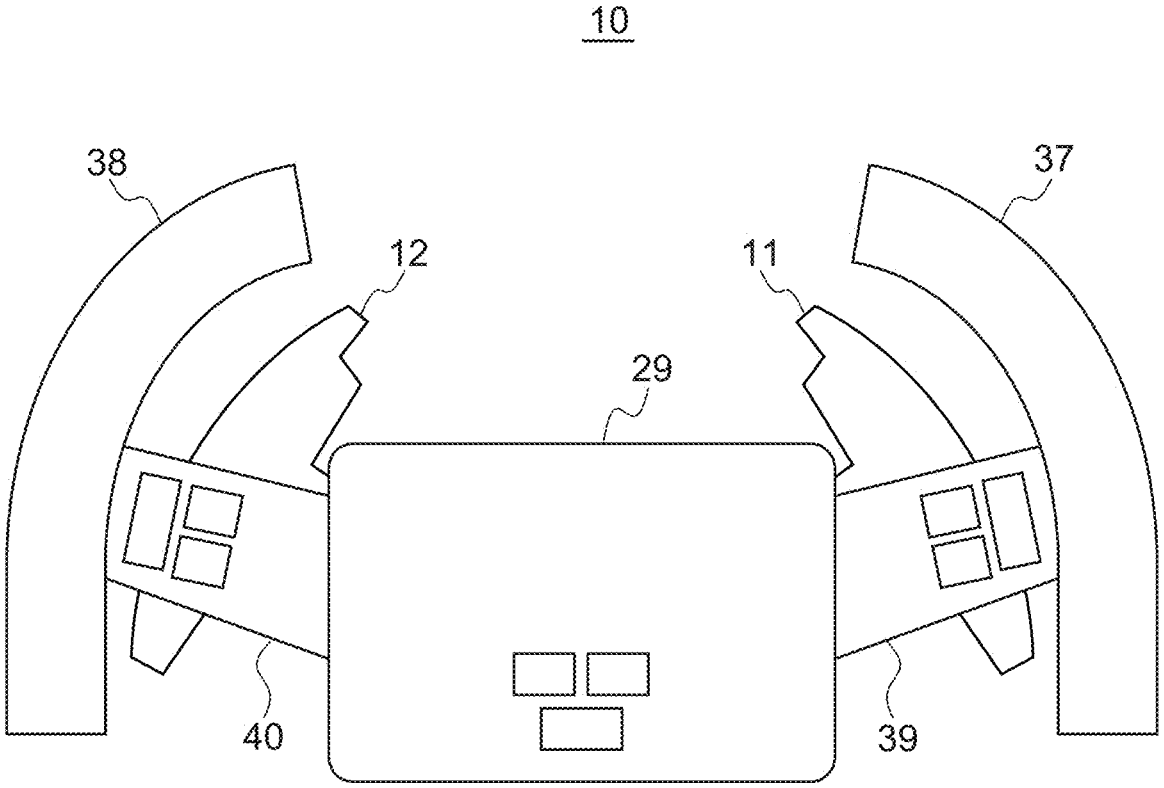
FIG. 6 is a view for explaining a configuration of a first modified example of the steering mechanism for the marine vessel.

Furthermore, as shown in FIG. 6, instead of the wheel portion 30 that has the annular shape, the steering wheel 10 of the marine vessel steering mechanism 5 may be provided with handlebars 37 and 38, which are located on the right and the left, respectively. In this case, when the steering wheel 10 is viewed from the marine vessel operator, the speed adjusting paddle 11 is located so as to overlap a spoke portion 39 that connects the handlebar 37 located on the starboard side and the central portion 29, and the speed adjusting paddle 12 is located so as to overlap a spoke portion 40 that connects the handlebar 38 located on the port side and the central portion 29.

Furthermore, although the marine vessel steering mechanism 5 includes the speed adjusting paddles 11 and 12, instead of the speed adjusting paddles 11 and 12, speed adjusting levers having the same functions may be located on the marine vessel steering mechanism 5. As with the speed adjusting paddles 11 and 12, when the steering wheel 10 is viewed from the marine vessel operator, the speed adjusting levers are also located so that the spoke portions 32 and 33, and the speed adjusting levers overlap, respectively.

Figure 7:
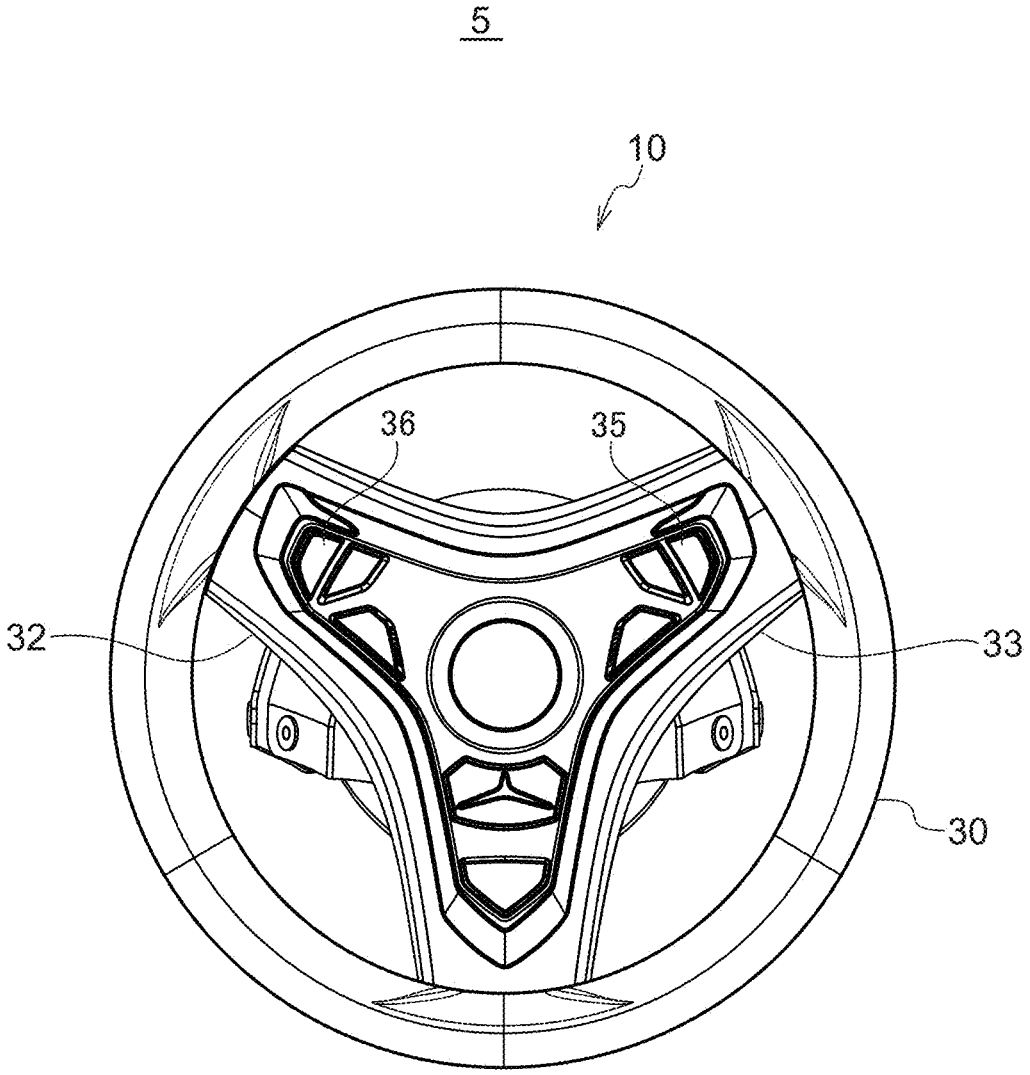
FIG. 7 is a view for explaining a configuration of a second modified example of the steering mechanism for the marine vessel.
Figure 8:
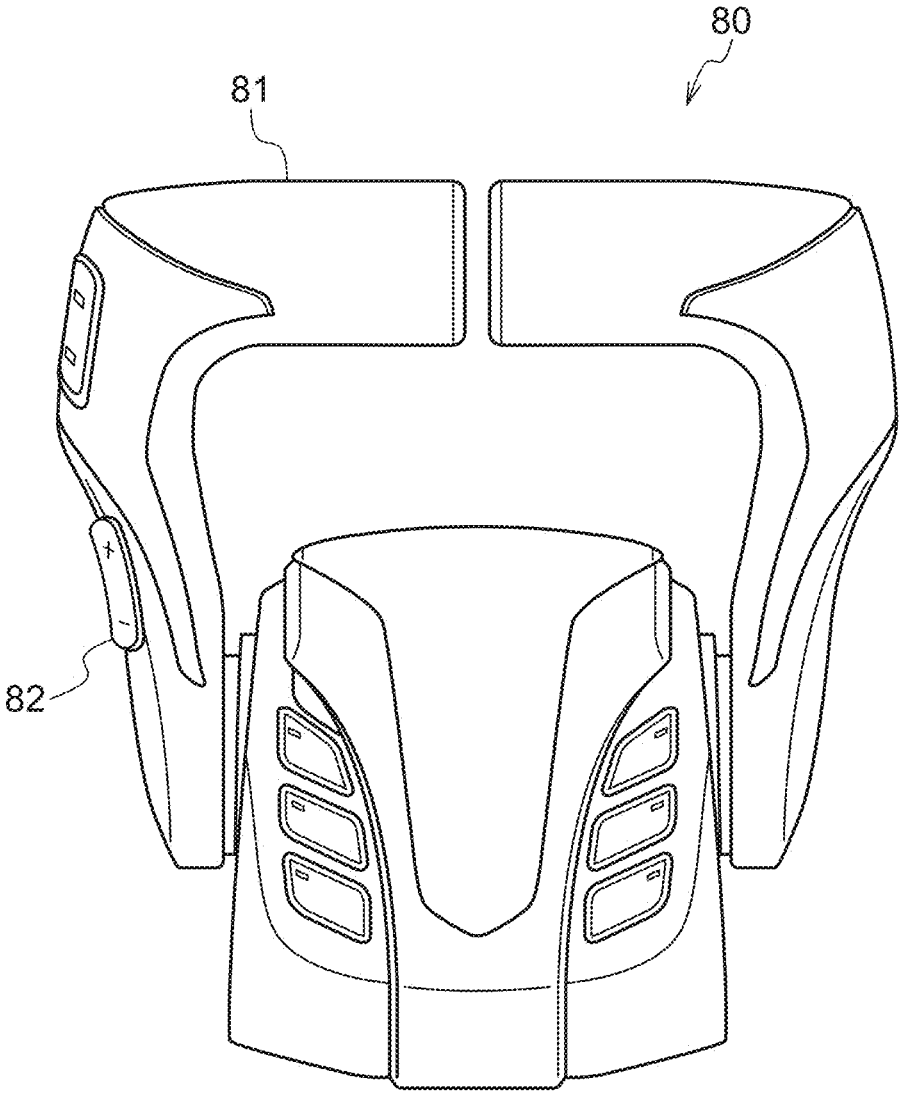
FIG. 8 PRIOR ART
FIG. 8 is a view for explaining a speed control switch of a conventional remote control switch.

Furthermore, as shown in FIG. 7, instead of the speed adjusting paddles 11 and 12, the marine vessel steering mechanism 5 may include a speed adjusting switch 35 (a speed increasing switch) that increases the vessel speed of the marine vessel 1 by operation thereof, and a speed adjusting switch 36 (a speed decreasing switch) that decreases the vessel speed of the marine vessel 1 by operation thereof. The speed adjusting switch 35 is located on the spoke portion 33, and the speed adjusting switch 36 is located on the spoke portion 32. It is preferable that both the speed adjusting switch 35 and the speed adjusting switch 36 are located within the range that the fingers of the marine vessel operator who is gripping the wheel portion 30, for example, thumbs, are able to reach.

In the CAN 22, an operation input to the speed adjusting switch 35 and an operation input to the speed adjusting switch 36 are transmitted as digital signals to the remote control ECU 19. Upon receiving a digital signal indicating that the speed adjusting switch 35 has been operated, the remote control ECU 19 performs the same process as when receiving the digital signal indicating that the speed adjusting paddle 11 has been operated. Furthermore, upon receiving a digital signal indicating that the speed adjusting switch 36 has been operated, the remote control ECU 19 performs the same process as when receiving the digital signal indicating that the speed adjusting paddle 12 has been operated.

In addition, as with the operation inputs to the speed adjusting paddles 11 and 12, the change amount of the rotation speed of the engine or the change amount of the vessel speed of the marine vessel 1 corresponding to the operation input to the speed adjusting switch 35 or the operation input to the speed adjusting switch 36 may be changed according to the vessel speed of the marine vessel 1.

Furthermore, as with the speed adjusting paddles 11 and 12, the speed adjusting switch 35 and the speed adjusting switch 36 may function as switches to shift the marine vessel 1 to the constant speed navigation mode. In this case, in the case that the navigation mode of the marine vessel 1 is not the constant speed navigation mode, when the marine vessel operator operates the speed adjusting switch 35 or the speed adjusting switch 36 once, the marine vessel 1 shifts to the constant speed navigation mode, and after the marine vessel 1 shifts to the constant speed navigation mode, when the marine vessel operator simultaneously operates the speed adjusting switch 35 and the speed adjusting switch 36, the constant speed navigation mode of the marine vessel 1 is released.

As described above, in the case that the speed adjusting switch 35 and the speed adjusting switch 36 are located on the spoke portion 33 and the spoke portion 32, respectively, the marine vessel operator gripping the wheel portion 30 is able to easily operate the speed adjusting switch 35 and the speed adjusting switch 36, and it is possible to improve the operability of the speed adjusting switch 35 and the speed adjusting switch 36. It should be noted that in order to prevent erroneous operations, the speed adjusting switch 35 and the speed adjusting switch 36 may be slightly recessed from the surface of the spoke portion 33 and the surface of the spoke portion 32, respectively.

Although the marine vessel steering mechanism 5 according to preferred embodiment of the present invention is applied to the marine vessel 1 including the two outboard motors 3, there is no limitation on the type of the marine vessel to which the marine vessel steering mechanism 5 is applied, and it may be applied to a marine vessel equipped with inboard/outboard motors or inboard motors.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel comprising:

a steering mechanism including:

a steering wheel;

a steering column that supports the steering wheel;

a speed increasing paddle to accelerate the marine vessel, the speed increasing paddle extending outward from the steering column; and a speed decreasing paddle to decelerate the marine vessel, the speed decreasing paddle extending outward from the steering column.

2. The marine vessel according to claim 1, wherein the speed increasing paddle and the speed decreasing paddle are separate from the steering wheel.

3. The marine vessel according to claim 1, wherein the steering wheel includes a central portion supported rotatably around a rotation fulcrum with respect to a hull of the marine vessel, a wheel portion having an annular shape, and at least two spoke portions that connect the central portion and the wheel portion;

the at least two spoke portions are positioned above a virtual plane extending through the rotation fulcrum and parallel to a left/right direction, and are positioned within an angle range from about 0° to about 60° with respect to the virtual plane in a circumferential direction about the rotation fulcrum; and the speed increasing paddle and the speed decreasing paddle are located so that when the steering wheel is viewed from a marine vessel operator, one spoke portion of the at least two spoke portions and the speed increasing paddle overlap each other, and the other spoke portion of the at least two spoke portions and the speed decreasing paddle overlap each other.

4. The marine vessel according to claim 1, wherein the speed increasing paddle and/or the speed decreasing paddle emits a digital signal to a controller that is configured or programmed to control propulsion devices of the marine vessel according to the digital signal.

5. The marine vessel according to claim 1, further comprising:

an engine; wherein when the speed increasing paddle is operated once, a rotation speed of the engine increases by a predetermined rotation speed; and when the speed decreasing paddle is operated once, the rotation speed of the engine decreases by a predetermined rotation speed.

6. The marine vessel according to claim 5, wherein the predetermined rotation speed varies according to a speed of the marine vessel.

7. The marine vessel according to claim 1, wherein when the speed increasing paddle is operated once, a speed of the marine vessel increases by a predetermined amount; and when the speed decreasing paddle is operated once, the speed of the marine vessel decreases by a predetermined amount.

8. The marine vessel according to claim 7, wherein the predetermined amount varies according to the speed of the marine vessel.

9. The marine vessel according to claim 1, wherein in a case that a navigation mode of the marine vessel is not a constant speed navigation mode in which the marine vessel navigates at a constant speed, when the speed increasing paddle and/or the speed decreasing paddle is operated, the navigation mode of the marine vessel shifts to the constant speed navigation mode.

10. A marine vessel comprising:

a steering mechanism including:

a steering wheel;

a speed increasing switch to accelerate the marine vessel; and a speed decreasing switch to decelerate the marine vessel; wherein the steering wheel includes a central portion supported rotatably around a rotation fulcrum with respect to a hull of the marine vessel, a wheel portion having an annular shape, and at least two spoke portions that connect the central portion and the wheel portion;

the at least two spoke portions are positioned above a virtual plane extending through the rotation fulcrum and parallel to a left/right direction, and are positioned within an angle range from about 0° to about 60° with respect to the virtual plane in a circumferential direction about the rotation fulcrum; and the speed increasing switch and the speed decreasing switch are located on the at least two spoke portions, respectively.

11. The marine vessel according to claim 10, wherein the speed increasing switch and the speed decreasing switch are located within a range that fingers of a marine vessel operator who is gripping the wheel portion are able to reach.

12. The marine vessel according to claim 10, wherein the speed increasing switch and/or the speed decreasing switch emits a digital signal to a controller configured or programmed to control propulsion devices of the marine vessel according to the digital signal.

13. The marine vessel according to claim 10, further comprising:

an engine; wherein when the speed increasing switch is operated once, a rotation speed of the engine increases by a predetermined rotation speed; and when the speed decreasing switch is operated once, the rotation speed of the engine decreases by a predetermined rotation speed.

14. The marine vessel according to claim 13, wherein the predetermined rotation speed varies according to a speed of the marine vessel.

15. The marine vessel according to claim 10, wherein when the speed increasing switch is operated once, a speed of the marine vessel increases by a predetermined amount; and when the speed decreasing switch is operated once, the speed of the marine vessel decreases by a predetermined amount.

16. The marine vessel according to claim 15, wherein the predetermined amount varies according to the speed of the marine vessel.

17. The marine vessel according to claim 10, wherein in a case that a navigation mode of the marine vessel is not a constant speed navigation mode in which the marine vessel navigates at a constant speed, when the speed increasing switch and/or the speed decreasing switch is operated, the navigation mode of the marine vessel shifts to the constant speed navigation mode.

18. A steering handle for a marine vessel, the steering handle comprising:

a steering wheel;

a steering column that supports the steering wheel;

a speed increasing paddle to accelerate the marine vessel, the speed increasing paddle extending outward from the steering column; and a speed decreasing paddle to decelerate the marine vessel, the speed decreasing paddle extending outward from the steering column.

* * * * *